US007946582B2

(12) United States Patent
Suh

(10) Patent No.: US 7,946,582 B2
(45) Date of Patent: May 24, 2011

(54) DOUBLE EFFICIENCY SHEET BUFFER MODULE AND MODULAR PRINTING SYSTEM WITH DOUBLE EFFICIENCY SHEET BUFFER MODULE

(75) Inventor: Eun Suk Suh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 149 days.

(21) Appl. No.: 12/413,802

(22) Filed: Mar. 30, 2009

(65) Prior Publication Data

US 2010/0244371 A1 Sep. 30, 2010

(51) Int. Cl.
*B65H 39/10* (2006.01)
*B65H 29/00* (2006.01)

(52) U.S. Cl. ..... 271/302; 271/184; 271/185; 271/182; 271/303

(58) Field of Classification Search ..... 271/184–186, 271/182, 302, 303
See application file for complete search history.

(56) References Cited

U.S. PATENT DOCUMENTS 6,107,579 A * 8/2000 Kinnemann ..... 177/145
6,161,828 A * 12/2000 Sussmeier ..... 270/59
6,450,711 B1 * 9/2002 Conrow ..... 400/582
7,093,831 B2 * 8/2006 Biegelsen et al. ..... 271/184
7,305,200 B2 12/2007 Hoffman et al.
7,330,677 B2 * 2/2008 Ogura ..... 399/88
7,426,043 B2 9/2008 Folkins et al.
7,549,723 B2 * 6/2009 Mihara et al. ..... 347/23
7,680,448 B2 * 3/2010 Mandel et al. ..... 399/381
7,706,737 B2 * 4/2010 Lang ..... 399/397
2008/0196606 A1 8/2008 Lang

OTHER PUBLICATIONS

Bober et al., U.S. Appl. No. 12/211,852, filed Sep. 17, 2008.
Bober et al., U.S. Appl. No. 12/211,853, filed Sep. 17, 2008.
Mandel et al., U.S. Appl. No. 12/331,768, filed Dec. 10, 2008.

* cited by examiner

*Primary Examiner* — Stefanos Karmis
*Assistant Examiner* — Luis A Gonzalez
(74) *Attorney, Agent, or Firm* — Gibb I.P. Law Firm, LLC

(57) ABSTRACT

Disclosed are a multi-sheet buffer module and a modular printing system incorporating the buffer module. The buffer module includes a primary sheet transport path that extends horizontally across a frame. Vertical buffer paths extend downward and upward from the primary sheet transport path. Each buffer path connects to a secondary sheet transport path, which provides a loop back connection to the primary sheet transport path. As a stream of sheets moves along the primary sheet transport path, sheets printed out of order will be selectively diverted into the sheet buffer paths. Then, at the proper moment, the sheet buffer paths will feed the buffered sheets into the secondary sheet transport path(s), which will transport them to the primary sheet transport path, such that they are inserted at the proper locations back into the stream of sheets.

18 Claims, 3 Drawing Sheets

DOUBLE EFFICIENCY SHEET BUFFER MODULE AND MODULAR PRINTING SYSTEM WITH DOUBLE EFFICIENCY SHEET BUFFER MODULE

BACKGROUND AND SUMMARY

This application is related to the following co-pending applications filed concurrently herewith by the same Applicants and assigned to the same Assignee: "SPACE EFFICIENT MULTI-SHEET BUFFER MODULE AND MODULAR PRINTING SYSTEM" Ser. No. 12/413,876 and "COMBINED SHEET BUFFER AND INVERTER" Ser. No. 12/413,923. The complete disclosures of these co-pending applications are incorporated in their entirety herein by reference.

Embodiments herein generally relate to modular printing systems and, more particularly, to a modular printing system incorporating a double efficiency sheet buffer module.

Modularity in printing systems, such as electrostatographic or other types of printing systems, is known. For example, U.S. patent application Ser. No. 12/211,853 of Bober et al., filed on Sep. 17, 2008, and U.S. patent application Ser. No. 12/331,768 of Mandel et al., filed on Dec. 10, 2008 (both of which are assigned to Xerox Corporation of Norwalk, Conn., USA, and incorporated herein by reference in their entirety) disclose modular printing systems comprising multiple modules (i.e., discrete interchangeable units). Each module comprises one or more functional components (e.g., sheet feeders, printing engines, sheet inverters, sheet buffers, finishers, etc.), each of which is structurally self contained within its own supporting frame and housing (i.e., cabinet).

Often times multi-page documents contain both single color (i.e., monochrome) pages (e.g., text-only pages) and multi-color pages (e.g., pages with colored graphics and/or images only or pages with combinations of text and colored graphics and/or images). Since it is more cost and time efficient to print single color pages using a single color printing engine vice a multi-color printing engine, modular printing systems incorporating heterogeneous printing engine modules (e.g., a single color and multi-color printing engine) in a tightly integrated parallel printing (TIPP) architecture have been developed (e.g., see U.S. patent application Ser. No. 12/211,853 of Bober et al. and U.S. patent application Ser. No. 12/331,768 of Mandel et al., incorporated by reference above). Such modular printing systems can print multi-page documents, having both single color and multi-color pages, in simplex and/or duplex formats. To ensure that the various single and multi-color pages are printed on print media sheets by the appropriate printing engine(s), a sorting process is performed. Once printed, the single color and multi-color pages are merged in order to output the finished document with all pages in the proper order. However, timing of sheet output from the different print engines to ensure proper page merging presents a problem for a number of reasons. For example, since multi-color print engines are typically more costly to run and since multi-page documents typically have significantly more text-only pages than multi-color pages, it is more cost efficient to print all or batches of multi-color pages together. This minimizes the number of on-off and warm-up cycles performed by the multi-color printing engine during a single print job, but results in multi-color pages being printed out of order and, particularly, early. One solution to this problem is to add a multi-sheet buffer module. Such a buffer module can be configured to pull, from a stream, sheets which have been printed early, to hold those sheets, and to subsequently insert those sheets back into the stream at the proper time.

In view of the foregoing, disclosed herein are embodiments of a multi-sheet buffer module and a modular printing system incorporating such a multi-sheet buffer module. The multi-sheet buffer module is configured with a primary sheet transport path that extends horizontally across a support frame from an input port to an output port. Vertically oriented parallel sheet buffer paths extend downward and upward from the primary sheet transport path. Each buffer path connects to a secondary sheet transport path, which provides a loop back connection to the primary sheet transport path. A stream of sheets will enter the primary sheet transport path at the input port. As the stream moves in the direction of the output port, sheets printed out of order and, particularly, early will be selectively diverted into the sheet buffer paths. At the proper moment, the sheet buffer paths will feed the buffered sheets into the secondary sheet transport path(s), which will transport them back to the primary sheet transport path such that they are inserted at the proper locations back into the stream of sheets. By orienting the sheet buffer paths in this manner, the width of the sheet buffer module can be decreased, while keeping constant or increasing the sheet buffering capacity.

Specifically, an embodiment of a multi-sheet buffer module can comprise a frame having a first side and a second side opposite the first side. This module can comprise a middle sheet transport path (i.e., a primary sheet transport path), upper and lower sheet transport paths (i.e., secondary sheet transport paths) and upper and lower sheet buffer paths. The middle sheet transport path can extend essentially horizontally across the middle of the frame from a sheet input port on the first side to a sheet output port on the second side. The upper sheet transport path can be above the middle sheet transport path. The lower sheet transport path can be below the middle sheet transport path. The upper sheet transport path and the lower sheet transport path can each have a first portion aligned with and approximately parallel to the middle sheet transport path and a second portion connected to the middle sheet transport path adjacent to the sheet output port. That is, the second portion of both the upper sheet transport path and lower sheet transport path can provide a loop back connection to the middle sheet transport path.

The upper sheet buffer paths can extend essentially vertically from the middle sheet transport path to the first portion of the upper sheet transport path. Similarly, the lower sheet buffer paths can extend essentially vertically from the middle sheet transport path to the first portion of the lower sheet transport path. Configuring the sheet buffer paths in this manner ensures that any sheet transported from the middle sheet transport path through a sheet buffer path and into either the upper sheet transport path or the lower sheet transport path will re-enter the middle sheet transport path adjacent to the sheet output port. Each sheet buffer path can have a length sufficient to hold one or more print media sheets. Furthermore, the upper and lower sheet buffer baths can have different lengths and thereby different buffering capacities.

In operation, a stream of sheets (e.g., sheets printed by a modular printing system that provides for single color printing in simplex or duplex format, multi-color printing in simplex or duplex format and, optionally, mixed printing) are fed into the sheet input port of the sheet buffer module. The middle sheet transport path receives the stream of sheets at the sheet input port. Then, as the stream of sheets is being transported by the middle sheet transport path in the direction of the sheet output port, at least one sheet buffer path of the upper and/or lower sheet buffer paths diverts at least one selected sheet from the stream (e.g., a sheet that was printed out of order and, particularly, early), holds that selected sheet, and subsequently feeds that selected sheet to the corresponding upper or lower sheet transport path at the proper moment such that, as that selected sheet re-enters the middle sheet transport path, it is inserted back into the stream at a predetermined point (i.e., at the proper location within the document being printed).

To accomplish this, the buffer module can comprise a controller that is operatively connected to the middle sheet transport path and the upper and lower sheet buffer paths so as to control movement of the sheets within the buffer module. Specifically, each sheet buffer path can have a corresponding gate and one or more sheet transport devices. The gate can be selectively controlled (e.g., by the controller) to force selected sheets to enter the sheet buffer path from the middle sheet transport path on demand. Additionally, the one or more sheet transport devices can be selectively controlled (e.g., by the controller) to force sheets, which are being held, to exit the sheet buffer path on demand.

The above-described multi-sheet buffer module embodiment can be incorporated into any modular printing system requiring sheet buffering in order to output a finished document with all pages in the proper order (e.g., a modular printing system that provides for single color printing in simplex or duplex format, multi-color printing in simplex or duplex format and, optionally, mixed printing (i.e., one side of a sheet printed in a single color, the opposite side of the same sheet printed in multiple colors)). Such a modular printing system can comprise a first printing engine module (e.g., a multiple color printing engine module) and a second printing engine module (e.g., a single color printing engine module) positioned adjacent to the first printing engine module (e.g., stacked on top of the first printing engine module). Sheets for a multi-page document printed by the first print engine module and/or the second print engine module can be merged and fed in single stream into the sheet input port of the sheet buffer module. As described in detail above, the buffer module can be configured to divert selected sheet(s) from the stream (e.g., any sheet(s) that were printed out of order or, particularly, early), to hold the selected sheet(s), and to subsequently cause the selected sheet(s) to be inserted back into the stream at a predetermined point (i.e., at the proper location within the document being printed) prior to being output to, for example, a finishing module.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
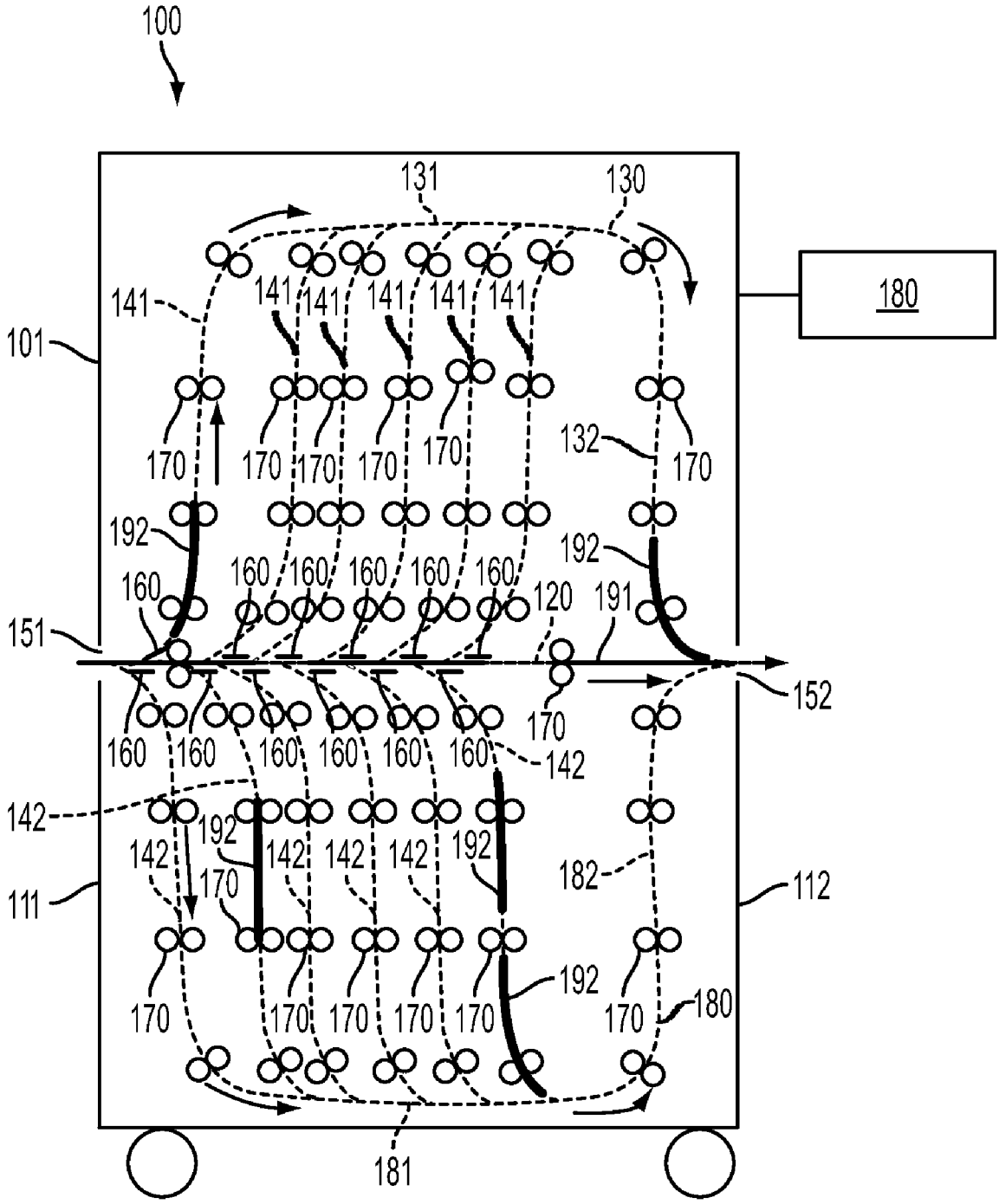
FIG. 1 is a schematic diagram illustrating an embodiment of a multi-sheet buffer module.

As mentioned above, modularity in printing systems, such as electrostatographic or other types of printing systems, is known. For example, U.S. patent application Ser. No. 12/211,853 of Bober et al., filed on Sep. 17, 2008, and U.S. patent application Ser. No. 12/331,768 of Mandel et al., filed on Dec. 10, 2008 (both of which are assigned to Xerox Corporation of Norwalk, Conn., USA, and incorporated herein by reference in their entirety) disclose modular printing systems comprising multiple modules (i.e., discrete interchangeable units). Each module comprises one or more functional components (e.g., sheet feeders, printing engines, sheet inverters, sheet buffers, finishers, etc.), each of which is structurally self contained within its own supporting frame and housing (i.e., cabinet).

Often times multi-page documents contain both single color (i.e., monochrome) pages (e.g., text-only pages) and multi-color pages (e.g., pages with colored graphics and/or images only or pages with combinations of text and colored graphics and/or images). Since it is more cost and time efficient to print single color pages using a single color printing engine vice a multi-color printing engine, modular printing systems incorporating heterogeneous printing engine modules (e.g., a single color and multi-color printing engine) in a tightly integrated parallel printing (TIPP) architecture have been developed (e.g., see U.S. patent application Ser. No. 12/211,853 of Bober et al. and U.S. patent application Ser. No. 12/331,768 of Mandel et al., incorporated by reference above). Such modular printing systems can print multi-page documents, having single color and multi-color pages, in simplex and/or duplex formats. To ensure that the various single color and multi-color pages are printed on print media sheets by the appropriate printing engine(s), a sorting process is performed. Once printed, the single color and multi-color pages are merged in order to output the finished document with all pages in the proper order. However, timing of sheet output from the different print engines to ensure proper page merging presents a problem for a number of reasons. For example, since multi-color print engines are typically more costly to run and since multi-page documents typically have significantly more text-only pages than multi-color pages, it is more cost efficient to print all or batches of multi-color pages together. This minimizes the number of on-off and warm-up cycles performed by the multi-color printing engine during a single print job, but results in multi-color pages being printed out of order and, particularly, early. One solution to this problem is to add a multi-sheet buffer module. Such a buffer module can be configured to pull, from a stream, sheets which have been printed early, to hold those sheets, and to subsequently insert those sheets back into the stream at the proper time.

In view of the foregoing, disclosed herein are embodiments of a multi-sheet buffer module and a modular printing system incorporating such a multi-sheet buffer module. The multi-sheet buffer module is configured with a primary sheet transport path that extends horizontally across a support frame from an input port to an output port. Vertically oriented parallel sheet buffer paths extend downward and upward from the primary sheet transport path. Each buffer path connects to a secondary sheet transport path, which provides a loop back connection to the primary sheet transport path. A stream of sheets (e.g., sheets printed by a modular printing system that provides for single color printing in simplex or duplex format, multi-color printing in simplex or duplex format and, optionally, mixed printing) will enter the primary sheet transport path at the input port. As the stream moves in the direction of the output port, sheets printed out of order and, particularly, early will be selectively diverted into the sheet buffer paths. At the proper moment, the sheet buffer paths will feed the buffered sheets into the secondary sheet transport path(s), which will transport them back to the primary sheet transport path such that they are inserted at the proper locations back into the stream of sheets. By orienting the sheet buffer paths in this manner, the width of the sheet buffer module can be decreased, while keeping constant or increasing the sheet buffering capacity.

Referring to FIG. 1, an embodiment of a multi-sheet buffer module 100 can comprise a supporting frame 101 having a first side 111 and a second side 112 opposite the first side 111. This module 100 can comprise a middle sheet transport path 120 (i.e., a primary sheet transport path), upper and lower sheet transport paths 130, 180 (i.e., secondary sheet transport paths) and upper and lower sheet buffer paths 141, 142 (e.g., 6 upper and 6 lower sheet buffer paths, as shown, 10 upper and 10 lower sheet buffer paths, 20 upper and 20 lower sheet buffer paths, etc.). The middle sheet transport path 120, the upper and lower sheet transport paths 130, 180 and the upper and lower sheet buffer paths 141, 142, can each comprise sheet transport devices 170 (e.g., as nip apparatuses (as shown) and/or transport belts) that are configured (e.g., with a drive roller) to cause print media sheets entering the path to be transported in a given direction.

The middle sheet transport path 120 can extend essentially horizontally across the middle of the supporting frame 101 from a sheet input port 151 on the first side 111 to a sheet output port 152 on the second side 111. The upper sheet transport path 130 can be above the middle sheet transport path 120. The lower sheet transport path 180 can be below the middle sheet transport path 120. The upper sheet transport path 130 and the lower sheet transport path 180 can each have a first portion 131, 181 and a second portion 132, 182.

Specifically, the first portion 131 of the upper sheet transport path 130 can be positioned above, aligned with and approximately parallel to the middle sheet transport path 120. The second portion 132 of the upper sheet transport path 130 can provide a connection between an end of the first portion 131 and the middle sheet transport path 120 adjacent to the sheet output port 152. The upper sheet buffer paths 141 can extend essentially vertically upward from the middle sheet transport path 120 to the first portion 131 of the upper sheet transport path 130. Thus, the second portion 132 of the upper sheet transport path 130 provides a loop back connection between the upper sheet buffer paths 141 and the middle sheet transport path 120.

Similarly, the first portion 181 of the lower sheet transport path 180 can be positioned below, aligned with and approximately parallel to the middle sheet transport path 180. The second portion 182 of the lower sheet transport path 180 can provide a connection between an end of the first portion 181 and the middle sheet transport path 120 adjacent to the sheet output port 152. The lower sheet buffer paths 142 can extend essentially vertically downward from the middle sheet transport path 120 to the first portion 181 of the lower sheet transport path 180. Thus, the second portion 182 of the lower sheet transport path 180 provides a loop back connection between the lower sheet buffer paths 142 and the middle sheet transport path 120.

Configuring the sheet buffer paths 141, 142 in this manner ensures that any sheet transported from the middle sheet transport path 120 through a sheet buffer path 141, 142 and into either the upper sheet transport path 130 or into the lower sheet transport path 180 will re-enter the middle sheet transport path 120 adjacent to the sheet output port 152.

Each sheet buffer path 141, 142 can have a length sufficient to hold one or more print media sheets. Those skilled in the art will recognize that the length of each sheet buffer path 141, 142 and, thereby the number of sheets which can be held by each sheet buffer path 141, 142 (i.e., the sheet buffering capacity) is limited by the dimensions of the buffer module 100. For example, the lower sheet buffer paths 142 can be configured to have a length that is only slightly less than the distance between the sheet input port 151 and the bottom of the frame 100. Additionally, the upper sheet buffer paths 141 can be configured to have a length that is only slightly less than the distance between the sheet input port 151 and the top of the frame 100. Although, as shown, the upper and lower sheet buffer paths appear to have approximately equal lengths, it is anticipated that the upper and lower sheet buffer paths may have different lengths and, thus, different buffering capacities. That is, the upper sheet buffer paths may each be configured to hold a different number of sheets that the lower sheet buffer paths. Furthermore, those skilled in the art will recognize that the numbers of vertically oriented sheet buffer paths 141, 142 are similarly limited by the dimensions of the buffer module 100 and also by the space required for each sheet buffer path 141, 142, including sheet transport devices 170.

In operation, a stream 191 of sheets (e.g., for a multi-page document printed by a modular printing system that provides for single color and multi-color printing in simplex and/or duplex format) are fed into the sheet input port 151 of the sheet buffer module 100. The middle sheet transport path 120 receives the stream 191 of sheets at the sheet input port 152. Then, as the stream 191 of sheets is being transported by the middle sheet transport path 120 in the direction of the sheet output port 152, at least one sheet buffer path of the upper and/or lower sheet buffer paths 141, 142 diverts at least one selected sheet 192 from the stream 191 (e.g., a sheet that was printed out of order and, particularly, early), holds that selected sheet 192, and subsequently feeds that selected sheet 192 to the corresponding upper or lower sheet transport path 130, 180 at the proper moment such that, as that selected sheet re-enters the middle sheet transport path 120, it is inserted back into the stream 191 at a predetermined point (i.e., at the proper location within the document being printed).

To accomplish this, the buffer module 100 can comprise a controller 180 that is operatively connected to the middle sheet transport path 120 and the upper and lower sheet buffer paths 141, 142 so as to control movement of the all sheets through the buffer module 100. Specifically, the controller 180 can access, from an internal or external data storage device, information indicating the proper order of the sheets within the stream 191 and also indicating the actual order of the sheets within the stream 191 as they are received at the sheet input port 151. Based on this information, the controller 180 can determine which sheets are out of order, can select those sheets, and can cause the buffer module 100 to perform the required buffering so as to achieve the proper order (e.g., to ensure that the multi-page document is output at the sheet output port 152 with the sheets in the stream 191 in the proper order). Those skilled in the art will recognize that controller 180 can be programmed with computer usable program code and can further comprise a processor adapted to execute the code in order to perform these functions.

More particularly, based on a comparison of the proper sheet order and the actual sheet order, the controller 180 can cause gates 160 within the buffer module 100 to divert, into the sheet buffer paths 141, 142, one or more selected sheets 192 (e.g., sheets printed out of order and, particularly, early) and subsequently can cause sheet transport device(s) 170 within the sheet buffer paths 141, 142 to insert those selected sheets 192 back into the stream 191 passing through the middle sheet transport path 120 at the proper moment so that the proper sheet order is achieved when the stream 191 is output at the sheet output port 152. Specifically, each sheet buffer path 141, 142 can have a corresponding gate 160 and one or more sheet transport devices 170. Each gate 160 can be positioned at the intersection between the middle sheet transport path 120 and its corresponding sheet buffer path 141, 142. Actuation of each gate 160 can be selectively controlled (e.g., by the controller 180) to either allow sheets to pass along the middle sheet transport path 120 directly to the sheet output port 152 or to force sheets to divert into (i.e., enter into) the corresponding sheet buffer path 141, 142 on demand. For example, each gate 160 can be configured as a baffle or diverter capable of pivoting movement in order to control the direction a sheet travels (i.e., along the middle sheet path 120 or into a corresponding sheet buffer path 141, 142). The pivoting movement of each gate 160 can be individually and automatically controlled by the controller 180. Additionally, actuation of individual sheet transport devices 170 (e.g., nips, as shown, or electrostatic transport belts) within the sheet buffer paths 141, 142 can be selectively controlled (e.g., by the controller 180) to allow any one specific sheet 192 to maintain its position within a specific sheet buffer path 141, 142 or to force any one specific sheet 192 being held within a specific sheet buffer path 141, 142 to exit the sheet buffer path and thereby, enter the corresponding upper or lower sheet transport path 130, 180 on demand. For example, each sheet transport device 170 can be configured with a conventional drive roller, which rotates so as to directly (e.g., in the case of nips) or indirectly (e.g., in the case of transport belts) cause a sheet to move in a given direction. Rotation of each drive roller can be controlled by a motor, which in turn can be individually and automatically by the controller 180.

The above-described multi-sheet buffer module 100 embodiments can be incorporated into a modular printing system that requires or that would benefit from sheet buffering in order to output a multi-page document with all pages in the proper order. For example, referring to FIG. 2, the multi-sheet buffer module 100, described in detail above, can be incorporated into a modular printing system 10 such as that disclosed in U.S. patent application Ser. No. 12/211,853 of Bober et al. (incorporated by reference above).

Figure 2:
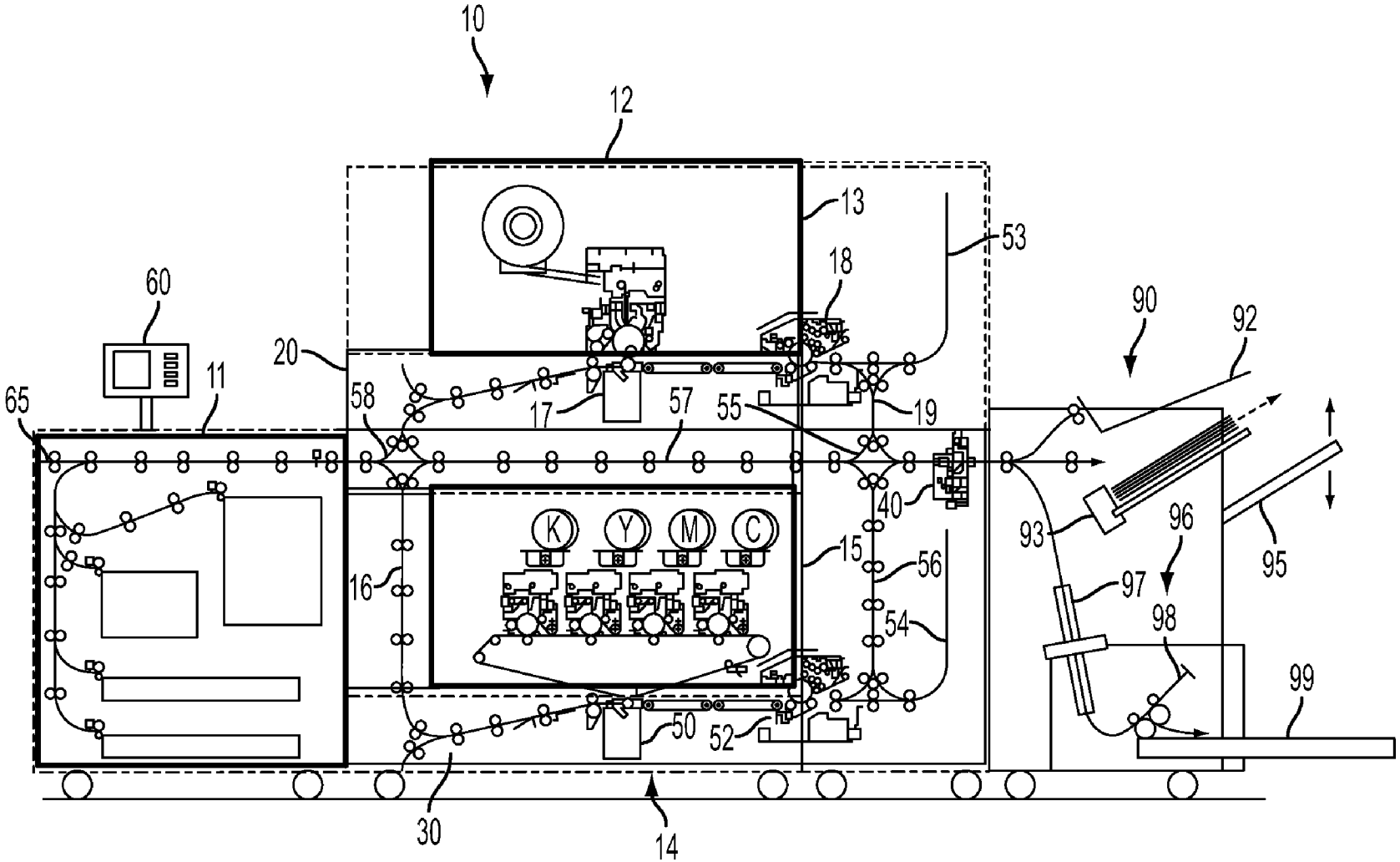
FIG. 2 is a schematic diagram illustrating a modular printing system.

Specifically, U.S. patent application Ser. No. 12/211,853 of Bober et al. (incorporated by reference above) discloses a modular printing system 10, as illustrated in FIG. 2, that provides for single color printing in simplex or duplex format, multi-color printing in simplex or duplex format and mixed printing (i.e., printing on one side of a sheet using a single color printing engine and on the opposite side of the same sheet using a multi-color printing engine). This modular printing system 10 outputs a merged stream of single color sheets in simplex or duplex format, multi-color sheets in simplex or duplex format and, optionally, mixed sheets (i.e., sheets printed on one side with a single color and on the opposite side with multiple colors) into a finisher module 90 and would benefit the incorporation of a multi-sheet buffer module capable of re-ordering sheets from the merged stream, as necessary, prior to processing by the finisher module 90. The modular printing system 10 comprises a sheet feed module 11, first and second electronic printers 12 and 14 that include a conventional monochrome marking engine module 13 and a conventional color image marking engine module (IME) 15, respectively, and a paper transport path leading into and out of each printer that includes media path modules 20 and 30 connecting these three modules and associated for tightly integrated parallel printing of documents with the system. Finished output from the printing system is sent to a conventional finisher 90.

For simplex monochrome copies, feeder module 11 includes a plurality of conventional sheet feeders that feed sheets into a media path highway 57 and into a conventional diverter gate system 58 that conveys the sheets into upper media path module 20 and on to transfer station 17 to have images from IME 13 transferred thereto. The sheets are then transported through fuser 18 and into inverter 53 where the sheet is inverter for proper face down output collation exiting to the vertical path 19, through a diverter gate system 53, decurler 40 and into finisher 90. Alternatingly, unimaged sheets from sheet feed module 11 are fed downward through the diverter gate system 58 into vertical transport 16 and through lower media path module 30 to transfer station 50 to receive images from IME 15. The sheets are then transported through fuser 52, into inverter 54 for proper face down output collation, exiting into vertical transport 56, through diverter gate system 55 and through decurler 40 en route to conventional finisher 90 accepts unstapled sheets in upper catch tray 92 or stapled sheet at 93 in intermediate catch tray 95 or sheets stapled at 97 in booklet maker 96 and folded into booklets at folder 98 and outputted onto lower catch tray 99. Control station 60 allows an operator to selectively control the details of a desired job. Optionally, an insert or interposed sheet, such as, a cover, photo, tab sheet or other special sheet can be inserted into the first printer engine from an auxiliary sheet feed source (not shown) through sheet input 65, if desired.

For color image duplexing, sheets can be fed from feeder module 11 through diverter system 58, into color electronic printer 14 and downward along vertical transport 16 to lower media path module 30 and on to transfer station 50 to receive images on a first side thereof from IME 15 that includes cyan, magenta, yellow and black developer housings. Afterwards, the sheets are forwarded through fuser 52 and into inverter 54. The sheets leave inverter 54 trail edge first and are fed upwards along media transport path 56 and into media path highway 57, through diverter gate systems 55 and 58 and eventually downward along vertical transport 16 and back to lower media path module 30 and again through transfer station 50 to receive images onto a second side of the sheets. The sheets are then fused at fuser 52 and transported upward along media path 56, through diverter gate system 55 and out through decurler 40 and into finisher 90. For monochrome image duplexing, sheets can be fed from feeder module 11 through diverter gate system 58, into monochrome electronic printer 12 and into the media path module 20 and on to transfer station 17 to receive monochrome images on a first side thereof from IME 13 that includes a black developer housing only. Afterwards, the sheets are forwarded through fuser 18 and into inverter 53. The sheets leave inverter 53 trail edge first and are fed downwards along media transport path 19, through diverter gate system 55 and into media path highway 57, through diverter gate system 58 and back to upper media path module 20 and again through transfer station 17 to receive monochrome images onto a second side of the sheets. The sheets are then fused at fuser 18 and transported downward along media path 19, through diverter gate system 55 and out through decurler 40 and into finisher 90. Or alternatingly, combinations of one side monochrome and one side color imaged duplexed sheets can be produced by using these same media path elements in the appropriate sequences.

Figure 3:
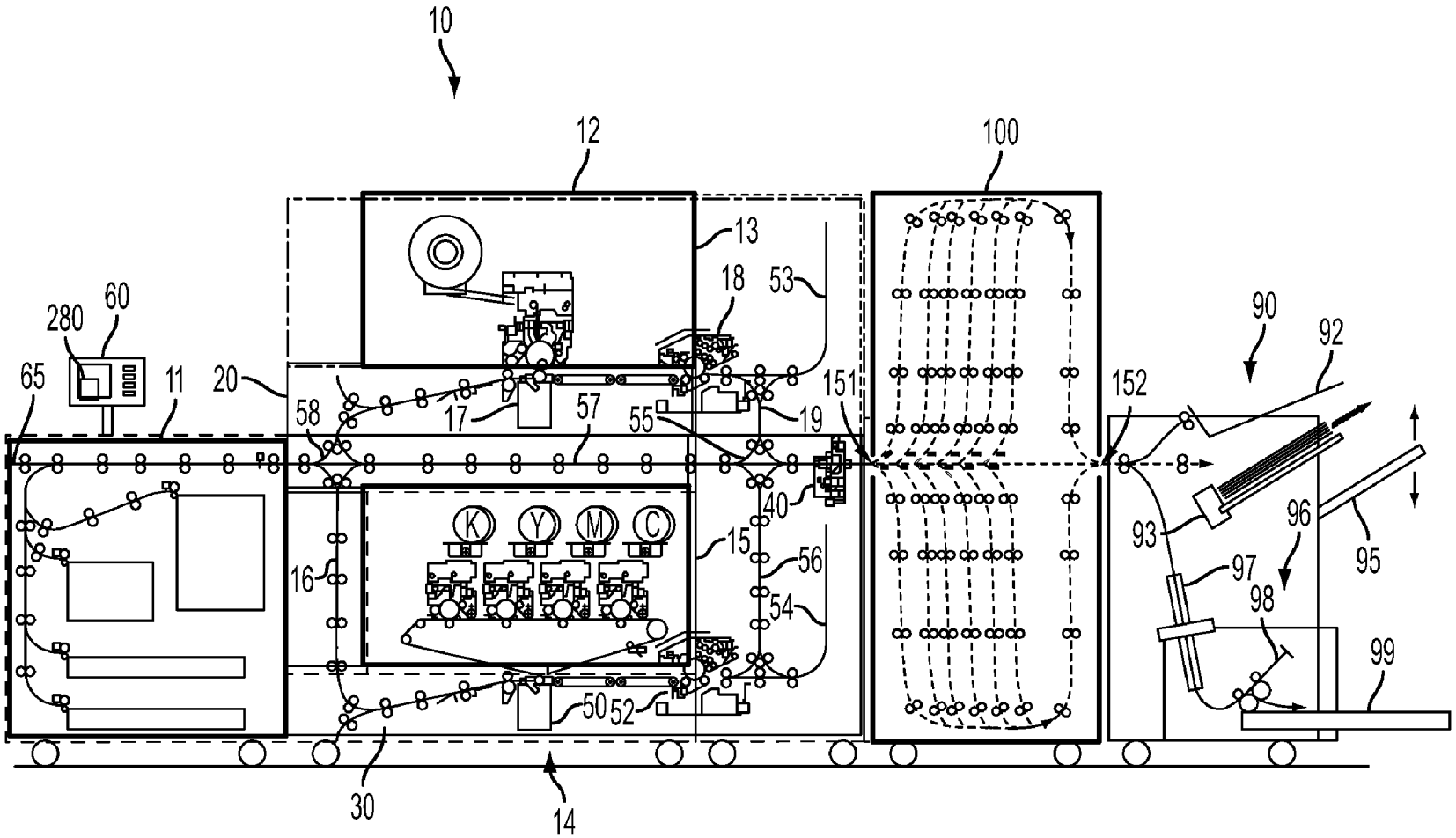
FIG. 3 is a schematic diagram illustrating the modular printing system of FIG. 3 incorporating the buffer module of FIG. 1.

The multi-sheet buffer module 100 of FIG. 1 can easily be incorporated into this modular printing system 10, as illustrated in FIG. 3. That is, an embodiment of a modular printing system 10 as disclosed herein and illustrated in FIG. 3, can comprise a first printing engine module 14 (e.g., a multiple color printing engine module) and a second printing engine module 12 (e.g., a single color printing engine module) positioned adjacent to the first printing engine module (e.g., stacked on top of the first printing engine module 14). Various sheet transport paths and, optional, inverters can extend between and through the printing engine modules 14, 12, as described above, to allow for single color, and multi-color printing in simplex and/or duplex format. The outputs of the printing engine modules 14, 12 can be merged into a single stream of single color sheets and multi-color sheets. Optionally, this single stream can pass through a decurler 40. However, before passing into a finisher module 90, this single stream may be directed into the input port 151, 251 of a multi-sheet buffer module 100 of FIG. 1.

As described in detail above and illustrated in FIG. 1, the multi-sheet buffer module 100 can be configured to divert selected sheet(s) 192 from the stream 191 (e.g., any sheet(s) that were printed out of order or, particularly, printed early by the printers 14, 12), to hold the selected sheet(s) 192 and to subsequently cause the selected sheet(s) 192 to be inserted back into the stream 191 at a predetermined point (i.e., at the proper location within the document being printed) prior to being output to, for example, the finishing module 90.

It should be understood that the controller 180 described above and illustrated in FIG. 1 can be integrated into the control station 60 of the modular printing system 10 of FIG. 3. The control station 60 can preferably comprise a programmable, self-contained, dedicated mini-computer having a central processor unit (CPU), electronic storage, and a display or user interface (UI) and can function as the main control system for the multiple modules (e.g., the feeder module, printing engine modules, sheet buffer module, etc.) within the modular printing system 10.

It should further be understood that the terms "image printing device", "printing device", "printing engines", "printing machine", "printer", "printing system", etc., as used herein encompass any of a digital copier, bookmaking machine, facsimile machine, multi-function machine, etc. which performs a print outputting function. The details of printing devices (e.g., printers, printing engines, etc.) are well-known by those ordinarily skilled in the art. Printing devices are readily available devices produced by manufactures such as Xerox Corporation, Norwalk, Conn., USA. Such printing devices commonly include input/output, power supplies, processors, media movement devices, marking devices etc., the details of which are omitted herefrom to allow the reader to focus on the salient aspects of the embodiments described herein. Additionally, the term "print medium" as used herein encompasses any cut sheet or roll of print media suitable for receiving images, pictures, figures, drawings, printed text, handwritten text, etc. Exemplary print media include, but are not limited to, a paper, plastic, and vinyl.

It should further be understood that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Disclosed above are embodiments of a multi-sheet buffer module and a modular printing system incorporating such a multi-sheet buffer module. The multi-sheet buffer module is configured with a primary sheet transport path that extends horizontally across a support frame from an input port to an output port. Vertically oriented parallel sheet buffer paths extend downward and upward from the primary sheet transport path. Each buffer path connects to a secondary sheet transport path, which provides a loop back connection to the primary sheet transport path. A stream of sheets will enter the primary sheet transport path at the input port. As the stream moves in the direction of the output port, sheets printed out of order and, particularly, early will be selectively diverted into the sheet buffer paths. At the proper moment, the sheet buffer paths will feed the buffered sheets into the secondary sheet transport path(s), which will transport them back to the primary sheet transport path such that they are inserted at the proper locations back into the stream of sheets. By orienting the sheet buffer paths vertically in this manner, the sheet buffering capacity can remain constant, while reducing the width of the sheet buffer module, as compared to the sheet buffering capacity and width of sheet buffer modules with horizontally oriented sheet buffer paths.

What is claimed is:

1. A multi-sheet buffer module comprising:

a frame having a first side and a second side opposite said first side;

a linear middle sheet transport path extending horizontally across said frame from a sheet input port on said first side to a sheet output port on said second side, said sheet input port and said sheet output port being located at a same height on said frame and said sheet input port receiving a merged stream of sheets from multiple different printing engines;

an upper sheet transport path above said middle sheet transport path and a lower sheet transport path below said middle sheet transport path, said upper sheet transport path and said lower sheet transport path each having a first portion approximately parallel to said middle sheet transport path and a second portion connected to said middle sheet transport path adjacent said sheet output port;

a plurality of upper sheet buffer paths extending from said middle sheet transport path to said first portion of said upper sheet transport path;

a plurality of lower sheet buffer paths extending from said middle sheet transport path to said first portion of said lower sheet transport path such that any sheet transported from said middle input path through a sheet buffer path and into one of said upper sheet transport path and said lower sheet transport path re-enters said middle sheet transport path adjacent said sheet output port; and a controller operatively connected to said middle sheet transport path, said upper sheet buffer paths and said lower sheet buffer paths and selectively controlling movement of individual sheets being transported through said buffer module so as to selectively re-order said sheets in said merge stream of sheets and achieve a desired order for said sheets in said merged stream of sheets as said merged stream of sheets is output from said sheet output port.

2. The buffer module of claim 1, said controller further controlling said movement such that any sheet in said merged stream of sheets can be diverted from said middle sheet transport path into any sheet buffer path, held for a different predetermined period of time than other sheets diverted from said middle sheet transport path into other sheet buffer paths and subsequently fed to a corresponding one of said upper sheet transport path and said lower sheet transport path such that, as said any sheet re-enters said middle sheet transport path, said any sheet is inserted back into said merged stream of sheets at a predetermined point to achieve said desired order.

3. The buffer module of claim 1, each sheet buffer path having a corresponding gate, said controller selectively controlling said gate to force selected sheets to enter said sheet buffer path from said middle sheet transport path on demand.

4. The buffer module of claim 1, each sheet buffer path comprising at least one sheet transport device, said controller selectively controlling said at least one sheet transport device to force any sheet held by said sheet buffer path to exit said sheet buffer path on demand.

5. The buffer module of claim 1, each sheet buffer path having a length sufficient to hold at least one print media sheet.

6. A multi-sheet buffer module comprising:

a frame having a first side and a second side opposite said first side;

a linear middle sheet transport path extending horizontally across said frame from a sheet input port on said first side to a sheet output port on said second side, said sheet input port and said sheet output port being located at a same height on said frame and said sheet input port receiving a merged stream of sheets from multiple different printing engines;

an upper sheet transport path above said middle sheet transport path and a lower sheet transport path below said middle sheet transport path, said upper sheet transport path and said lower sheet transport path each having a first portion approximately parallel to said middle sheet transport path and a second portion connected to said middle sheet transport path adjacent said sheet output port;

a plurality of upper sheet buffer paths extending from said middle sheet transport path to said first portion of said upper sheet transport path, each of said upper sheet buffer paths having a first length;

a plurality of lower sheet buffer paths, each upper sheet buffer path and each lower sheet buffer path having a second length different from said first length such that said upper sheet buffer paths and said lower sheet buffer paths have different buffering capacities and said lower sheet buffer paths extending from said middle sheet transport path to said first portion of said lower sheet transport path such that any sheet transported from said middle input path through a sheet buffer path and into one of said upper sheet transport path and said lower sheet transport path re-enters said middle sheet transport path adjacent said sheet output port; and a controller operatively connected to said middle sheet transport path, said upper sheet buffer paths and said lower sheet buffer paths and selectively controlling movement of individual sheets being transported through said buffer module so as to selectively re-order said sheets in said merge stream of sheets and achieve a desired order for said sheets in said merged stream of sheets as said merged stream of sheets is output from said sheet output port.

7. The buffer module of claim 6, one of said first length and said second length being at least as long as two of said sheets so as to be able to hold at least two of said sheets at any given time.

8. The buffer module of claim 6, said controller further controlling said movement such that any sheet in said merged stream of sheets can be diverted from said middle sheet transport path into any sheet buffer path, held for a different predetermined period of time than other sheets diverted from said middle sheet transport path into other sheet buffer paths and subsequently fed to a corresponding one of said upper sheet transport path and said lower sheet transport path such that, as said any sheet re-enters said middle sheet transport path, said any sheet is inserted back into said merged stream of sheets at a predetermined point to achieve said desired order.

9. The buffer module of claim 6, each sheet buffer path having a corresponding gate, said controller selectively controlling said gate to force selected sheets to enter said sheet buffer path from said middle sheet transport path on demand.

10. The buffer module of claim 6, each sheet buffer path comprising at least one sheet transport device, said controller selectively controlling said at least one sheet transport device to force any sheet held by said sheet buffer path to exit said sheet buffer path on demand.

11. A printing system comprising:

a first printing engine module;

a second printing engine module adjacent said first printing engine module;

a multi-sheet buffer module comprising:

a frame having a first side and a second side opposite said first side;

a linear middle sheet transport path extending horizontally across said frame from a sheet input port on said first side to a sheet output port on said second side, said sheet input port and said sheet output port being located at a same height on said frame and said sheet input port receiving a merged stream of sheets from said first printing engine module and said second printing engine module;

an upper sheet transport path above said middle sheet transport path and a lower sheet transport path below said middle sheet transport path, said upper sheet transport path and said lower sheet transport path each having a first portion approximately parallel to said middle sheet transport path and a second portion connected to said middle sheet transport path adjacent said sheet output port;

a plurality of upper sheet buffer paths extending from said middle sheet transport path to said first portion of said upper sheet transport path; and a plurality of lower sheet buffer paths extending from said middle sheet transport path to said first portion of said lower sheet transport path such that any sheet transported from said middle input path through a sheet buffer path and into one of said upper sheet transport path and said lower sheet transport path re-enters said middle sheet transport path adjacent said sheet output port; and a controller operatively connected to said middle sheet transport path, said upper sheet buffer paths and said lower sheet buffer paths and selectively controlling movement of individual sheets being transported through said buffer module so as to selectively re-order said sheets in said merge stream of sheets in order to achieve a desired order for said sheets in said merged stream of sheets as said merged stream of sheets is output at said sheet output port, said controller further controlling said movement such that any sheet in said merged stream of sheets can be diverted from said middle sheet transport path into any sheet buffer path, held for a different predetermined period of time than other sheets diverted from said middle sheet transport path into other sheet buffer paths and subsequently fed to a corresponding one of said upper sheet transport path and said lower sheet transport path such that, as said any sheet re-enters said middle sheet transport path, said any sheet is inserted back into said merged stream of sheets at a predetermined point to achieve said desired order.

12. The multi-sheet buffer module of claim 11, said first printing engine module and said second printing engine module being stacked, and said first printing engine module comprising a multi-color printing engine module and said second printing engine module comprising a single color printing engine module.

13. The multi-sheet buffer module of claim 11, each sheet buffer path having a corresponding gate, said controller selectively controlling said gate to force selected sheets to enter said sheet buffer path from said middle sheet transport path on demand.

14. The multi-sheet buffer module of claim 11, each sheet buffer path comprising at least one sheet transport device, said controller selectively controlling said at least one sheet transport device to force any sheet held by said sheet buffer path to exit said sheet buffer path on demand.

15. The multi-sheet buffer module of claim 11, each sheet buffer path having a length sufficient to hold at least one print media sheet.

16. A printing system comprising:

a first printing engine module;

a second printing engine module adjacent said first printing engine module;

a multi-sheet buffer module comprising:

a frame having a first side and a second side opposite said first side;

a linear middle sheet transport path extending horizontally across said frame from a sheet input port on said first side to a sheet output port on said second side, said sheet input port and said sheet output port being located at a same height on said frame and said sheet input port receiving a merged stream of sheets from said first printing engine module and said second printing engine module;

an upper sheet transport path above said middle sheet transport path and a lower sheet transport path below said middle sheet transport path, said upper sheet transport path and said lower sheet transport path each having a first portion approximately parallel to said middle sheet transport path and a second portion connected to said middle sheet transport path adjacent said sheet output port;

a plurality of upper sheet buffer paths extending from said middle sheet transport path to said first portion of said upper sheet transport path, each of said upper sheet buffer paths having a first length; and a plurality of lower sheet buffer paths, each upper sheet buffer path having a second length that is different from said first length such that said upper sheet buffer paths and said lower sheet buffer paths have different buffering capacities and said lower sheet buffer paths extending from said middle sheet transport path to said first portion of said lower sheet transport path such that any sheet transported from said middle input path through a sheet buffer path and into one of said upper sheet transport path and said lower sheet transport path re-enters said middle sheet transport path adjacent said sheet output port; and a controller operatively connected to said middle sheet transport path, said upper sheet buffer paths and said lower sheet buffer paths and selectively controlling movement of individual sheets being transported through said buffer module so as to selectively re-order said sheets in said merge stream of sheets in order to achieve a desired order for said sheets in said merged stream of sheets as said merged stream of sheets is output at said sheet output port, said controller further controlling said movement such that any sheet in said merged stream of sheets can be diverted from said middle sheet transport path into any sheet buffer path, held for a different predetermined period of time than other sheets diverted from said middle sheet transport path into other sheet buffer paths and subsequently fed to a corresponding one of said upper sheet transport path and said lower sheet transport path such that, as said any sheet re-enters said middle sheet transport path, said any sheet is inserted back into said merged stream of sheets at a predetermined point to achieve said desired order.

17. The multi-sheet buffer module of claim 16, one of said first length and said second length being at least as long as two of said sheets so as to be able to hold at least two of said sheets at any given time.

18. The multi-sheet buffer module of claim 16, said first printing engine module and said second printing engine module being stacked, and said first printing engine module comprising a multi-color printing engine module and said second printing engine module comprising a single color printing engine module.

* * * * *